US012691331B1

(12) United States Patent
Wang

(10) Patent No.: US 12,691,331 B1
(45) Date of Patent: Jul. 28, 2026

(54) HAND GRIP STRENGTHENER AND INJECTION MOLDING MANUFACTURING METHOD THEREOF

(71) Applicant: Yuansheng Wang, Ruzhou City (CN)

(72) Inventor: Yuansheng Wang, Ruzhou City (CN)

( * ) Notice: Subject to any disclaimer, the term of this patent is extended or adjusted under 35 U.S.C. 154(b) by 0 days.

(21) Appl. No.: 19/387,631

(22) Filed: Nov. 13, 2025

(51) Int. Cl.

| | |
|---|---|
| ***A63B 23/16*** | (2006.01) |
| ***A63B 21/00*** | (2006.01) |
| ***A63B 21/02*** | (2006.01) |
| ***A63B 21/04*** | (2006.01) |
| ***A63B 23/035*** | (2006.01) |

(52) U.S. Cl.
CPC ..... *A63B 23/16* (2013.01); *A63B 21/00072* (2013.01); *A63B 21/023* (2013.01); *A63B 21/0421* (2013.01); *A63B 21/4035* (2015.10); *A63B 23/03508* (2013.01)

(58) Field of Classification Search
CPC . A63B 23/16; A63B 21/0555; A63B 21/0557; A63B 21/4043; A63B 21/4019; A63B 2225/50; A63B 2225/20
See application file for complete search history.

(56) References Cited

U.S. PATENT DOCUMENTS 4,654,895 A * 4/1987 Peters ..... A41D 19/0017 2/161.1
4,753,434 A * 6/1988 Salvino ..... A63B 23/16 482/121
4,830,361 A * 5/1989 Hoffman ..... A63B 21/0004 482/50
4,905,988 A * 3/1990 Mooneyhan ..... A63B 59/20 482/121
5,060,934 A * 10/1991 Winston ..... A63B 23/16 482/126
5,308,299 A * 5/1994 Winston ..... A63B 23/16 482/126
5,409,436 A * 4/1995 Chang ..... A63B 23/16 482/121
D358,857 S * 5/1995 Yang ..... D21/684
5,445,582 A * 8/1995 Brown ..... A63B 21/4025 601/40
7,824,311 B1 * 11/2010 Hsu ..... A63B 23/16 482/126
8,133,158 B2 * 3/2012 An ..... A63B 23/16 482/44
10,881,903 B2 * 1/2021 An ..... A63B 23/16
11,052,283 B2 * 7/2021 An ..... A63B 23/16
D990,592 S * 6/2023 Ju ..... D21/684
D1,080,421 S * 6/2025 Gao ..... D10/46.1
12,364,901 B1 * 7/2025 Gao ..... A63B 23/03508
2004/0003687 A1 * 1/2004 An ..... A63B 21/0004 606/206
2008/0103026 A1 * 5/2008 An ..... A63B 21/023 482/49

(Continued)

*Primary Examiner* — Garrett K Atkinson
(74) *Attorney, Agent, or Firm* — Ying-Ting Chen

(57) ABSTRACT

A hand grip strengthener includes a first operation handle having a first handle body, a second operation handle which is movably coupled to the first operation handle and has a second handle body, wherein the first handle body and the second handle body are injection molded, a strength adjustment assembly is arranged to generate a resistance force to a relative movement between the first operation handle and the second operation handle.

9 Claims, 18 Drawing Sheets

(56) References Cited

U.S. PATENT DOCUMENTS

| | | | | |
|---|---|---|---|---|
| 2010/0255956 | A1* | 10/2010 | An | A63B 23/16 482/49 |
| 2011/0118635 | A1* | 5/2011 | Yamamoto | A61H 1/0262 601/5 |
| 2013/0012358 | A1* | 1/2013 | Lynn | A63B 23/16 220/737 |
| 2014/0038786 | A1* | 2/2014 | Garcia | A63B 21/00069 482/49 |
| 2015/0190675 | A1* | 7/2015 | Silagy | A63B 21/05 482/49 |
| 2015/0290491 | A1* | 10/2015 | An | A63B 21/00069 482/49 |
| 2016/0361222 | A1* | 12/2016 | Publicover | A61H 1/024 |
| 2019/0255383 | A1* | 8/2019 | An | A63B 21/00072 |
| 2019/0366145 | A1* | 12/2019 | Reda | A63B 1/00 |

* cited by examiner

HAND GRIP STRENGTHENER AND INJECTION MOLDING MANUFACTURING METHOD THEREOF

BACKGROUND OF THE PRESENT INVENTION

Field of Invention

The present invention relates to hand grip trainer, and more particularly to a hand grip strengthener which is manufactured by an injection molding process.

Description of Related Arts

Hand grip strengtheners are commonly used for exercise, rehabilitation, and improving hand muscle endurance. A typical hand grip strengthener generally comprises two opposing handles connected by a spring element. The handles are often made of rigid plastic materials formed by injection molding.

In conventional hand grip strengtheners, the handle structure is designed primarily for strength and durability. However, the molded handle surface often fails to provide sufficient comfort or grip stability during prolonged use, leading to slippage or user fatigue. Attempts to improve comfort by modifying the surface texture or coating layers often encounter bonding and deformation issues, especially when the coating layer experiences uneven stress during repeated squeezing operations.

In injection molding processes, another problem frequently encountered is poor filling performance in certain mold areas. When the molten material cannot fully or evenly fill recessed or thin-walled regions of the mold, the resulting product may contain air bubbles or exhibit insufficient hardness in local areas. If a portion is inadequately filled or the material density is uneven, it can easily become a weak point that leads to cracking or fracture during use.

SUMMARY OF THE PRESENT INVENTION

The invention is advantageous in that it provides a hand grip strengthener having an improved handle structure and molding process that effectively overcome the shortcomings of conventional designs.

Another advantage of the present invention is to provide a hand grip strengthener which adopts a composite molding structure formed by combining a soft material and a hard material through an integrated injection molding process. The two materials are selected to have natural adhesion compatibility, thereby achieving both structural rigidity and surface comfort without requiring additional adhesives.

Another advantage of the present invention is to provide a hand grip strengthener, wherein by selecting polypropylene (PP) and thermoplastic elastomer (TPE) or thermoplastic rubber (TPR) as the overmolded materials, the handle achieves a composite structure combining both hard and soft properties. The PP material provides rigidity, dimensional stability, and structural support, while the TPE or TPR layer offers elasticity, cushioning, and enhanced grip comfort. A particular advantage of this material combination lies in the natural adhesion compatibility between PP and TPE or TPR. The two materials can be integrally molded without requiring additional surface treatment or adhesives, ensuring a stable and durable bond between the soft and hard layers. This improves production efficiency, reduces manufacturing complexity, and prevents delamination or peeling of the coating layer during repeated use. Accordingly, the dual-material overmolding structure achieves both mechanical strength and user comfort, resulting in a handle that is more ergonomic, reliable, and long-lasting compared with those made from a single material.

Another advantage of the present invention is to provide a hand grip strengthener, wherein the soft material layer is prevented from sliding or deforming when the handle is subjected to uneven mechanical stress during repeated squeezing operations, thereby preventing delamination or detachment.

Another advantage of the present invention is to provide a hand grip strengthener, wherein an inner side of the curved spring mounting portion is provided with reinforcing ribs to increase the local rigidity of the curved portion and maintain dimensional stability during the injection molding process.

Another advantage of the present invention is to provide a hand grip strengthener, a slot formed at the high-stress bending region serves as a stress-relief structure during molding. When molten material is injected and solidified, internal stress tends to concentrate at the curved area, which may lead to cracking or fracture after demolding. By introducing the slot at this region, the residual molding stress is effectively released and redistributed, thereby preventing material cracking or structural failure caused by thermal contraction or uneven shrinkage after injection.

Another advantage of the present invention is to provide an injection molding manufacturing method for the hand grip strengthener, wherein an optimized gate (injection point) design configures the gate to be positioned corresponding to the middle region of the rear hand grip handle, particularly near the upper curved portion of the spring mounting portion, which is a high-stress area most susceptible to cracking. By placing the gate close to this region, the molten material maintains high fluidity and fills the cavity uniformly, thereby reducing air bubble formation and ensuring sufficient hardness and strength in the critical bending area.

Another advantage of the present invention is to provide an injection molding manufacturing method for the hand grip strengthener, wherein the gate position of the hard material is designed such that, after injection molding, a recessed groove is naturally formed at the gate area. During the subsequent overmolding of the soft material, this recessed groove serves as an interlocking feature that allows the soft material to flow into and firmly engage with the groove. As a result, the bonding interface between the hard and soft materials is mechanically reinforced, significantly improving the overall adhesion strength. In addition, the soft material layer covers the groove surface after molding, providing a smooth and continuous outer appearance. This not only conceals the gate marks formed during the first injection process but also enhances the overall aesthetic quality and surface uniformity of the hand grip handle.

Another advantage of the present invention is to provide a hand grip handle structure that not only offers improved tactile comfort but also ensures long-term structural stability and mechanical performance under repeated load conditions.

Additional advantages and features of the invention will become apparent from the description which follows, and may be realized by means of the instrumentalities and combinations particularly pointed out in the appended claims.

According to the present invention, the foregoing and other objects and advantages are attained by a hand grip strengthener, comprising:

a first operation handle which comprises a first handle body;

a second operation handle which is movably coupled to the first operation handle and comprises a second handle body, wherein the first handle body and the second handle body are injection molded; and a strength adjustment assembly arranged to generate a resistance force to a relative movement between the first operation handle and the second operation handle.

According to an embodiment, the first operation handle further comprises a first gripping layer which is overmolded on the first handle body, the second operation handle further comprises a second gripping layer which is overmolded on the second handle body.

According to an embodiment, the first handle body and the second handle body are made of a relatively rigid material, the first gripping layer and the second gripping layer are made of a relatively soft material.

According to an embodiment, the first handle body and the second handle body are made of polypropylene, the first gripping layer and the second gripping layer are made of thermoplastic elastomer or thermoplastic rubber.

According to an embodiment, the strength adjustment assembly comprises a spring element, wherein the first handle body comprises a first handle portion, a curved spring mounting portion extended from the first handle portion, and a first connecting portion, wherein the second handle body comprises a second handle portion, a base portion extended from the second handle portion and a second connecting portion which is movably connected to the first connecting portion, wherein the spring element is connected to the curved spring mounting portion and is inclinedly arranged between the curved spring mounting portion and the base portion of the second handle body, wherein the first gripping layer is overmolded on a rear side of the first handle portion, the second gripping layer is overmolded on a front side of the second handle portion.

According to an embodiment, the first handle body has a first indented groove formed at an upper portion of the first handle portion adjacent to the curved spring mounting portion, wherein the first gripping layer is integrally molded on the first handle portion to conceal the first indented groove.

According to an embodiment, the first indented groove is an injection gate mark after an injection molding process of the first handle body.

According to an embodiment, the first handle portion comprises a first bonding wall and a first enclosing stopper wall extended from the first bonding wall to define a first retention groove, wherein the first gripping layer is overmolded and fitted to the first bonding wall at the first retention groove.

According to an embodiment, the first handle body has a first indented groove formed at the first bonding wall at an upper portion of the first handle portion adjacent to the curved spring mounting portion, wherein the first gripping layer is integrally molded on the first handle portion to conceal the first indented groove.

According to an embodiment, the first retention groove is extended along a circumferential direction to occupy a quarter to three quarters of a circumference of the first handle portion.

According to an embodiment, the second handle body has a second indented groove formed at a rear side of the second connecting portion.

According to an embodiment, the second handle portion comprises a second bonding wall and a second enclosing stopper extended from the second bonding wall to define a second retention groove, wherein the second gripping layer is overmolded and fitted to the second bonding wall at the second retention groove, wherein the second retention groove is extended along a circumferential direction to occupy a quarter to three quarters of a circumference of the second handle portion.

According to an embodiment, the curved spring mounting portion is formed in a tapered configuration that is thicker at a lower portion adjacent to the first handle portion and gradually thinner toward an upper free end thereof.

According to an embodiment, a tapered groove is formed at a lower portion of the curved spring mounting portion, wherein the tapered groove is configured with a downwardly widened shape.

According to an embodiment, the curved spring mounting portion comprises a body portion and a reinforcing rib that is integrally protruded from an inner side of the body portion reinforcing rib.

According to an embodiment, the reinforcing rib has a width that gradually increases toward the first handle portion, the width of the reinforcing rib ranges from 5% to 90% of a top width of the body portion.

According to an embodiment, the curved spring mounting portion has a mounting groove at a top thereof for receiving and anchoring an end of the spring element.

According to an embodiment, the strength adjustment assembly comprises a spring element, wherein the first handle body comprises a first handle portion, a curved spring mounting portion extended from the first handle portion, and a first connecting portion, wherein the second handle body comprises a second handle portion, a base portion extended from the second handle portion and a second connecting portion which is movably connected to the first connecting portion, wherein the spring element is connected to the curved spring mounting portion and is inclinedly arranged between the curved spring mounting portion and the base portion of the second handle body, wherein the first handle body has a first indented groove formed at a bottom of the first connecting portion, wherein the second handle body has a second indented groove formed at a bottom of the second connecting portion.

According to an embodiment, the second handle portion has a recessed groove at a rear side thereof.

The present invention further provides a hand grip strengthener, comprising:

a first operation handle which comprises a first handle body injection molded by polypropylene, wherein the first handle body comprises a first handle portion, a curved spring mounting portion extended from the first handle portion, and a first connecting portion, wherein the first operation handle further comprises a first gripping layer which is a thermoplastic elastomer layer or thermoplastic rubber layer overmolded on the first handle portion of the first handle body, wherein the first handle body has a first indented groove formed at an upper portion of the first handle portion adjacent to the curved spring mounting portion, wherein the first gripping layer is integrally molded on the first handle portion to conceal the first indented groove which is an injection gate mark after an injection molding process of the first handle body.

a second operation handle which comprises a second handle body injection molded by polypropylene, wherein the second handle body comprises a second handle portion, a base portion extended from the second handle portion and a second connecting portion which is movably connected to the first connecting portion; and a strength adjustment assembly which comprises a spring element, a spring driving element, and an adjustment control element, wherein the spring element is arranged to generate a resistance force to a relative movement between the first operation handle and the second operation handle, the adjustment control element is arranged to drive the spring driving element to move, so as to drive the spring element to move and deform, so as to adjust the resistance force, wherein the spring element is connected to the curved spring mounting portion and is inclinedly arranged between the curved spring mounting portion and the base portion of the second handle body.

The present invention further provides an injection molding manufacturing method of a hand grip strengthener, comprising the following steps.

(a) Injection molding a first handle body which comprises a first handle portion, a curved spring mounting portion extended from the first handle portion, and a first connecting portion, and injection molding a second handle body which comprises a second handle portion, a base portion extended from the second handle portion and a second connecting portion which is arranged to be movably connected to the first connecting portion; and (b) Overmolding a first gripping layer on the first handle portion and a second gripping layer on the second handle portion, wherein the first handle body and the second handle body are made of a relatively rigid material, the first gripping layer and the second gripping layer are made of a relatively soft material.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
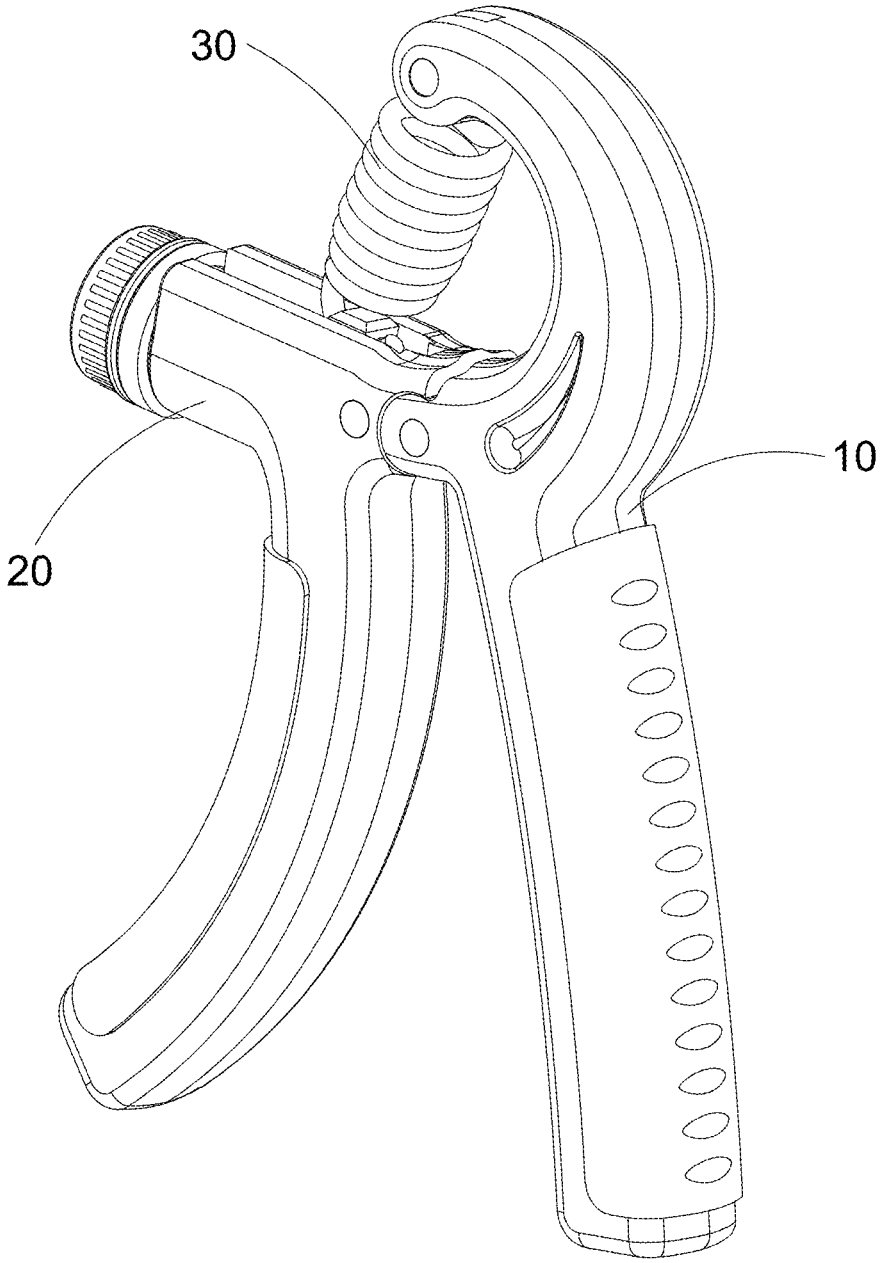
FIG. 1 is a perspective view of a hand grip strengthener according to an embodiment of the present invention.
Figure 2:
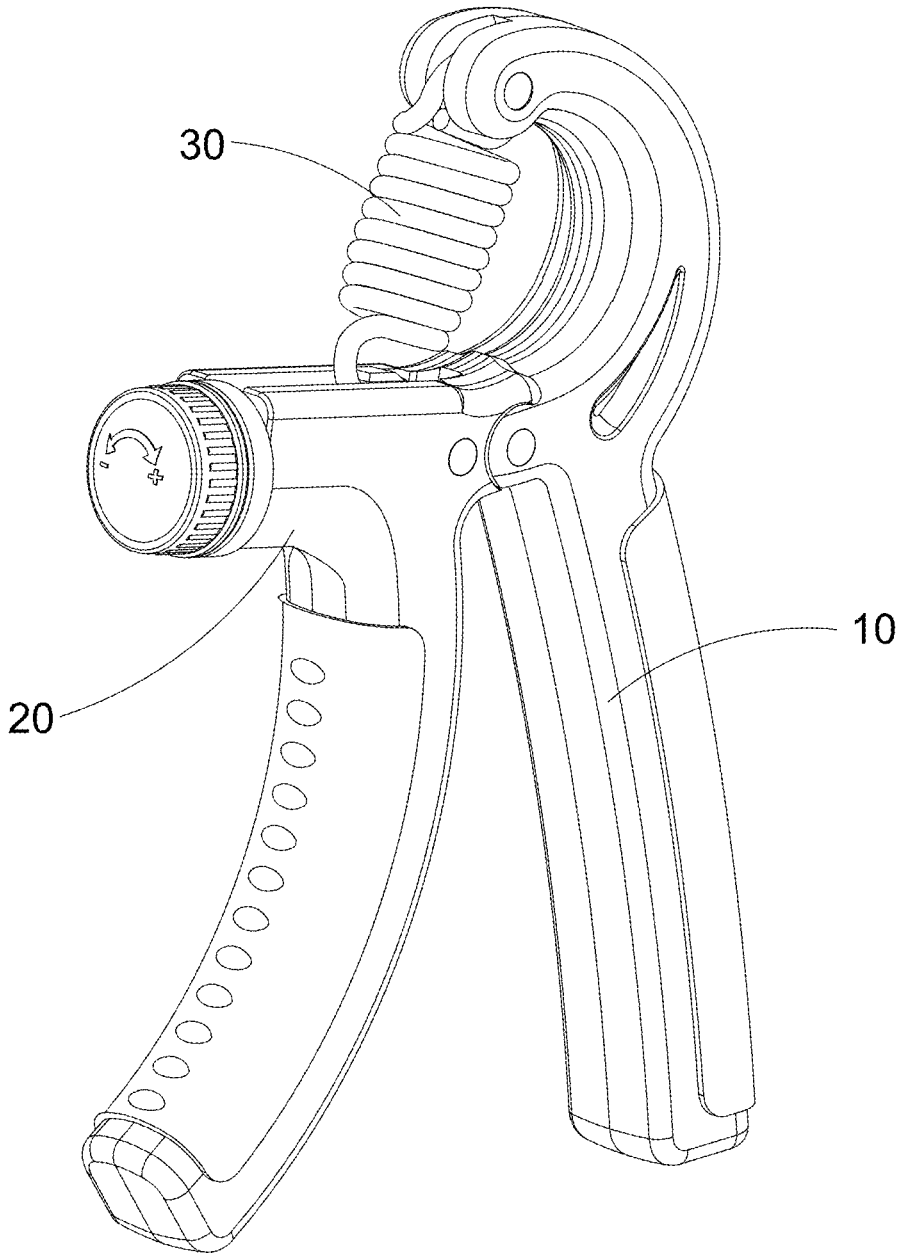
FIG. 2 is another perspective view of the hand grip strengthener according to the above embodiment of the present invention.
Figure 3:
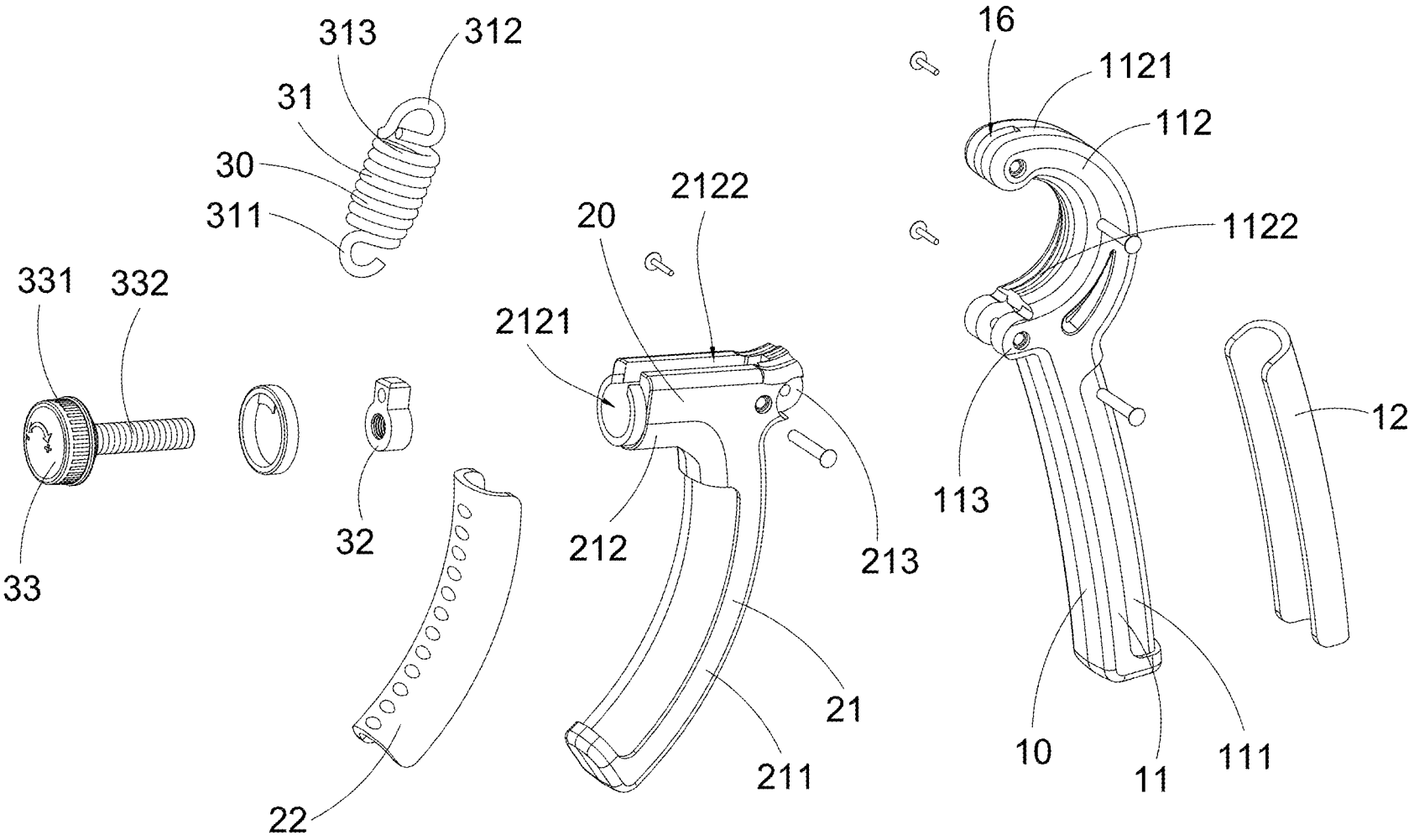
FIG. 3 is an exploded view of the hand grip strengthener according to the above embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 14 of the drawings, a hand grip strengthener according to a preferred embodiment of the present invention is illustrated, wherein the hand grip strengthener comprises a first operation handle 10, a second operation handle 20, a strength adjustment assembly 30 for adjusting the resistance for the user. The first operation handle 10 is coupled with the second operation handle 20 for a hand of a user to grip thereon and the two operation handles are capable of being moved away from or close to each other.

The strength adjustment assembly 30 comprises a spring element 31, a spring driving element 32, and an adjustment control element 33. The spring element 31 is arranged to generate a resistance force to the relative movement between the first operation handle 10 and the second operation handle 20, the adjustment control element 33 can be operated by the user, so as to drive the spring driving element 32 to move, and thus the spring element 31 is driven to move and deform, so as to adjust the resistance force.

In this embodiment, the first operation handle 10 and the second operation handle 20 are both manufactured by injection molding processes. The injection molding process ensures that the handles have consistent dimensions, high structural strength, and surface precision. The use of molded handles also facilitates the integration of complex geometrical features, such as internal cavities for assembling the spring mechanism, and external contours that conform to ergonomic gripping postures.

More specifically, the first operation handle 10 comprises a first handle body 11 which comprises a first handle portion 111, a curved spring mounting portion 112 extended from the first handle portion 111, and a first connecting portion 113 which is movably coupled to the second operation handle 20. The second operation handle 20 comprises a second handle body 21 which comprises a second handle portion 211, a base portion 212 connected to the second handle portion 211 for assembling the strength adjustment assembly 30, and a second connecting portion 213 extended from the base portion 212 for movably coupling with the first connecting portion 113.

The spring element 31 comprises a moving end portion 311 connected to the spring driving element 32, a fixing end portion 312, and a spring body 313 extended between the moving end portion 311 and the fixing end portion 312. The fixing end portion 312 is an end portion that is opposite to the moving end portion 311 and is fixed to the curved spring mounting portion 22. In this embodiment, the curved spring mounting portion 12 is integrally extended from a top of the first handle portion 11, and the spring element 31 is inclinedly extended between the curved spring mounting portion 12 and the base portion 22 of the second operation handle 20.

The base portion 212 has a guiding channel 2121 along a length thereof and an upper opening 2122 communicated to the guiding channel 2121, the moving end portion 311 is disposed in the guiding channel 2121 through the upper opening 2122 and can be driven by the spring driving element 32 to move in the guiding channel 2121.

The curved spring mounting portion 12, being integrally extended from the top of the first handle portion 11, provides a reinforced connection for supporting the fixing end portion 312 of the spring element 31. The curvature helps to disperse stress concentration at the junction between the mounting portion and the handle, effectively preventing cracking or breakage that could occur if the mounting structure were a flat or separately attached component. This integration also enhances the durability of the handle structure, especially under repeated compression cycles during long-term use. The inclined positioning of the spring element 31 allows the applied force to be transmitted along the spring's natural deformation path, resulting in uniform spring deflection. This minimizes lateral vibration or sudden changes in resistance, enabling smooth and stable operation during hand exercises.

Because the spring element 31 is mounted at an inclination and supported by a curved portion, the reaction force during gripping is distributed more evenly between the two handles. The user can experience a more natural squeezing motion, reducing hand fatigue and improving comfort during prolonged training sessions.

In this embodiment, the first handle portion 111, the curved spring mounting portion 112 and the first connecting portion 113 of the first handle body 11 are an integral piece integrally manufactured by injection molding, the second handle portion 211, the base portion 212 and the second connecting portion 213 of the second handle body 21 are an integral piece integrally manufactured by injection molding. Such an integral formation ensures that each handle body 11 and 21 possesses high structural rigidity and dimensional stability, thereby providing a firm foundation for the assembly of the spring element 31 and other components of the strength adjustment assembly 30.

The first operation handle 10 further comprises a first gripping layer 12 which is injection molded on the first handle body 11, the second operation handle 20 further comprises a second gripping layer 22 which is injection molded on the second handle body 21. The first handle body 11 and the second handle body 21 are made of a relatively rigid material such as polypropylene (PP), acrylonitrile butadiene styrene (ABS), polycarbonate (PC), or reinforced nylon, the first gripping layer 12 and the second gripping layer 22 are made of a relatively soft material such as thermoplastic polyurethane (TPU), thermoplastic elastomer (TPE), thermoplastic rubber (TPR), or silicone rubber. The overmolding process allows the gripping layers 12, 22 to be seamlessly fused to the handle bodies 11, 21, forming a smooth and visually unified appearance without visible gaps or edges. The dual-material structure not only adds to the aesthetic appeal but also improves tactile feedback, offering a professional and high-quality feel.

In this embodiment, the first handle body 11 and the second handle body 21 are made of polypropylene, the first gripping layer 12 and the second gripping layer 22 are made of thermoplastic elastomer (TPE) or thermoplastic rubber (TPR). The PP material provides high rigidity, dimensional stability, and structural support, forming a robust internal framework for the handles. In contrast, the thermoplastic elastomer (TPE) or thermoplastic rubber (TPR) material exhibits excellent elasticity, cushioning properties, and surface friction, which enhances grip comfort and prevents slippage during use.

A particular advantage of this material combination lies in the natural adhesion compatibility between PP and TPE or TPR. These two materials can be integrally overmolded through an injection molding process without requiring any additional surface treatment, primers, or adhesives. As a result, a firm and durable bond is formed between the soft and hard layers, effectively preventing delamination, peeling, or displacement of the TPE or TPR coating during repeated gripping operations.

From a manufacturing perspective, the integral overmolding process simplifies production, improves assembly efficiency, and reduces manufacturing costs, as no secondary adhesive or post-bonding operation is needed. From a functional standpoint, the dual-material structure combines mechanical strength and ergonomic comfort, providing a handle that is both structurally reliable and comfortable to hold. Accordingly, the PP-TPE/TPR composite handle achieves superior durability, tactile performance, and aesthetic appearance.

More specifically, the first gripping layer 12 is integrated on a rear side of the first handle body 11, the second gripping layer 22 is integrated on a front side of the second handle body 21, so that the first handle body 11 and the second handle body 21 are located between the first gripping layer 12 and the second gripping layer 22. When a holding hand of the user is gripped on the first operation handle 10 and the second operation handle 20, the fingers of the gripping hand are gripped on the first gripping layer 12, and the palm of the holding hand of the user rests on the second gripping layer 22.

This structural arrangement provides an ergonomically cushioned surface that conforms to the contour of the user's fingers and palm, so as to ensure that the soft gripping layers 12 and 22 directly contact both the fingers and palm of the user, thereby providing balanced comfort and anti-slip functionality on both the front and rear sides of the handles. The rigid handle bodies, located between the two soft gripping layers, serve as a mechanical core that maintains the overall rigidity and stability of the handles, while the outer soft layers enhance the tactile feel, frictional grip, and shock absorption.

By integrating the gripping layers on opposite sides of the handles, the design allows the user's hand to be naturally cushioned from both the front and rear directions during repeated squeezing operations. This configuration effectively reduces localized pressure on the hand, improves user comfort, and prevents slippage caused by perspiration, thereby enhancing the overall ergonomic performance and operational safety of the hand grip strengthener.

Figure 4:
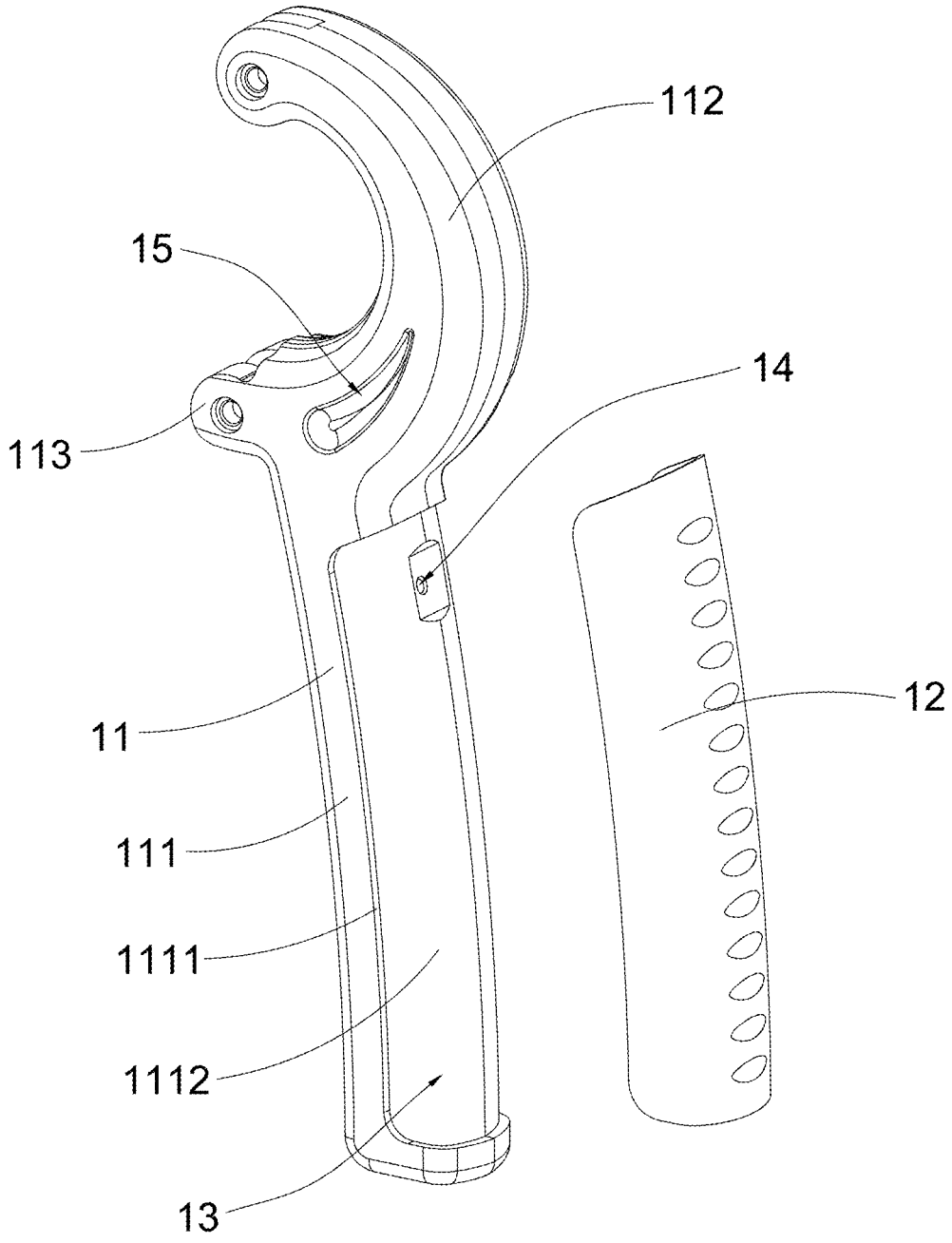
FIG. 4 is an exploded view of a first operation handle of the hand grip strengthener according to the above embodiment of the present invention.
Figure 5:
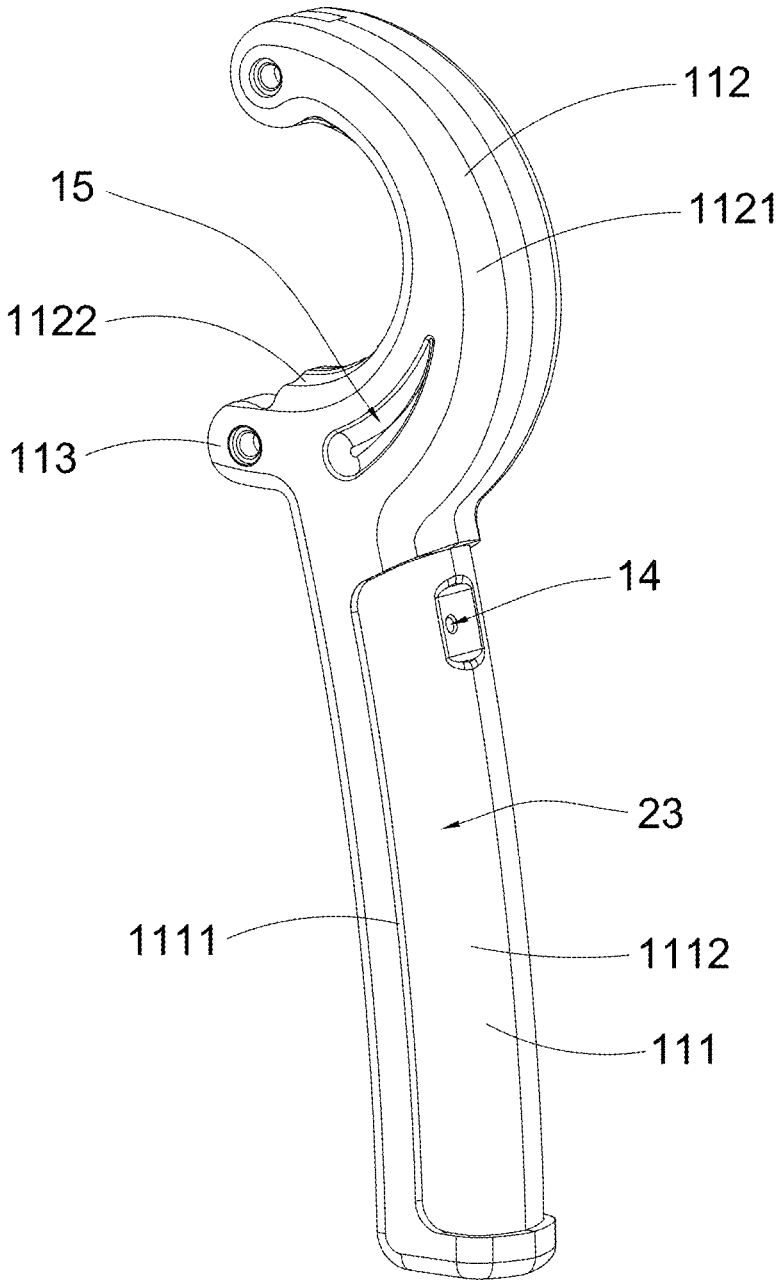
FIG. 5 is a perspective view of a first handle body of the hand grip strengthener according to the above embodiment of the present invention.
Figure 6:
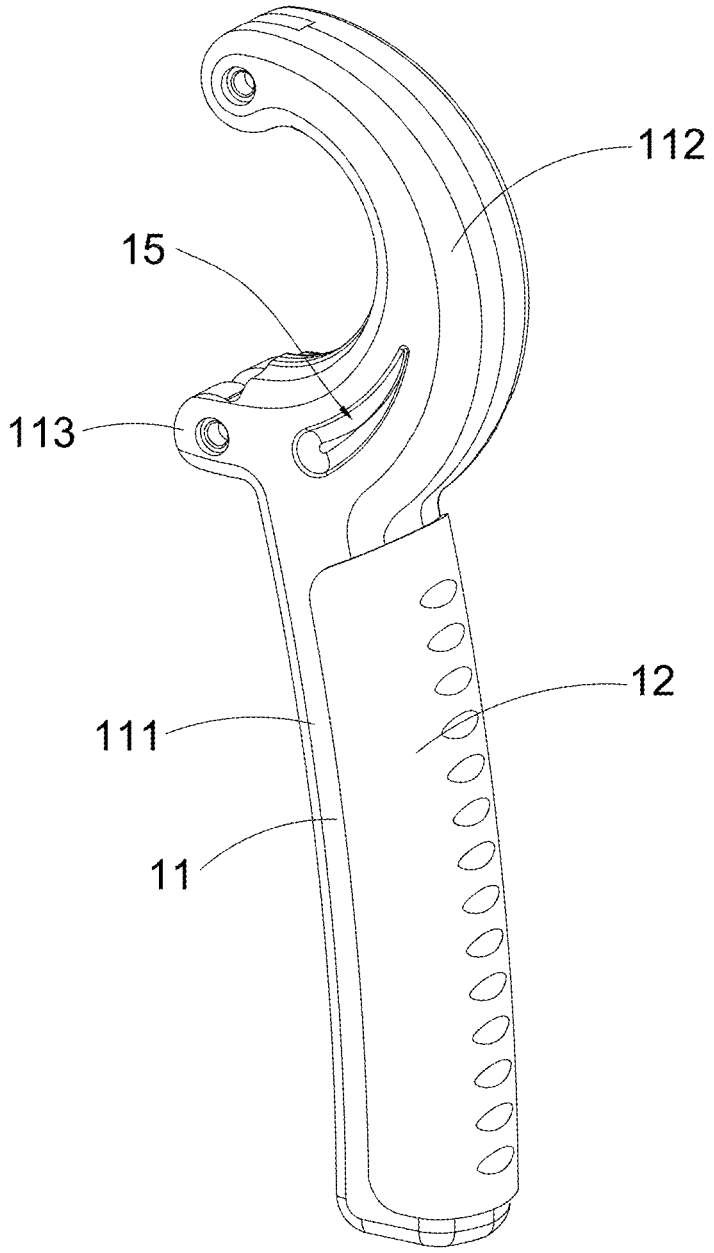
FIG. 6 is a schematic view of the first operation handle with the first gripping layer of the hand grip strengthener according to the above embodiment of the present invention.
Figure 7:
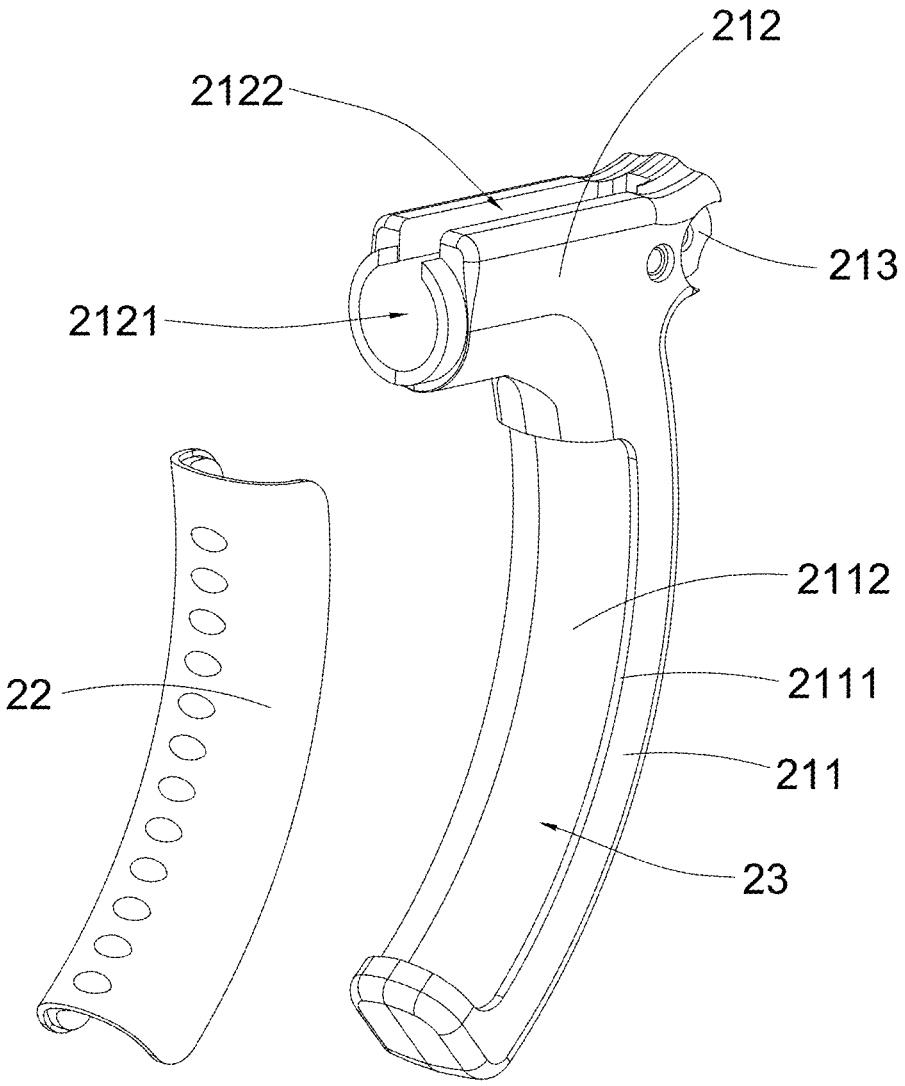
FIG. 7 is an exploded view of a second operation handle of the hand grip strengthener according to the above embodiment of the present invention.
Figure 8:
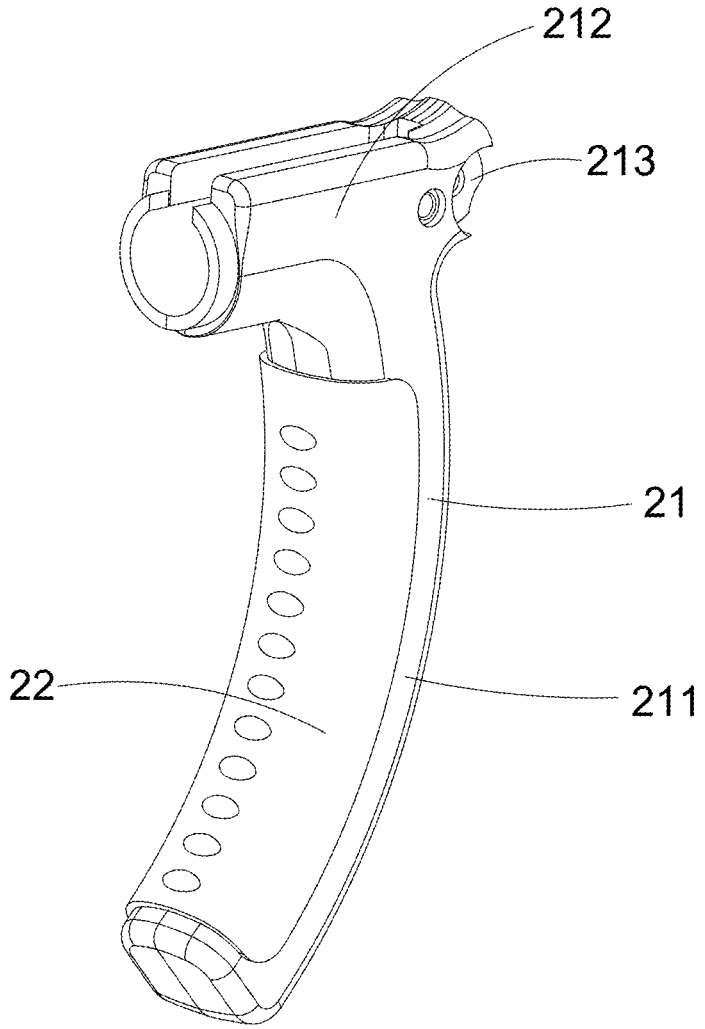
FIG. 8 is a schematic view of the second operation handle with the second gripping layer of the hand grip strengthener according to the above embodiment of the present invention.
Figure 9:
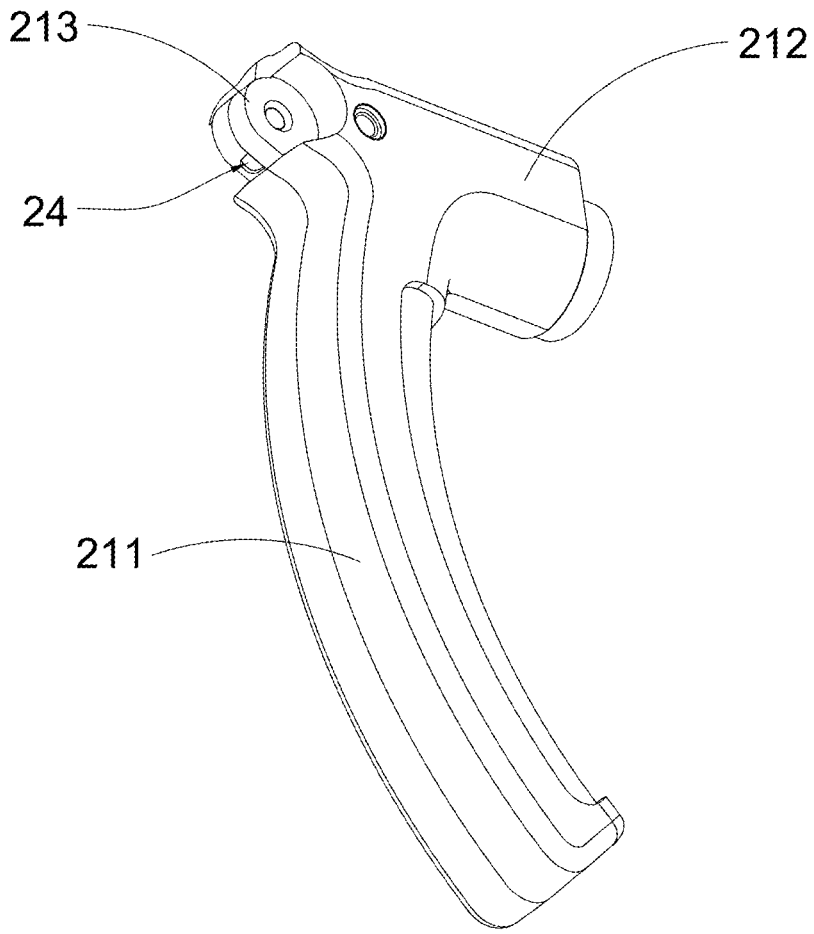
FIG. 9 is a perspective view of a second handle body of the hand grip strengthener according to the above embodiment of the present invention.

As shown in FIGS. 4 to 6 of the drawings, the first handle portion 111 comprises a first enclosing stopper wall 1111 and a first bonding wall 1112 which define a first retention groove 13 at a rear side of the first handle portion 111 for the first gripping layer 12. The first bonding wall 1112 is at a bottom of the first retention groove 13, the first enclosing stoppe wall 1111 is a surrounding wall of the first retention groove 13. As shown in FIGS. 7 to 9 of the drawings, the second handle portion 211 comprises a second enclosing stopper wall 2111 and a second bonding wall 2112 which define a second retention groove 23 at a front side of the second handle portion 211 for the second gripping layer 22. The second bonding wall 2112 is at a bottom of the second retention groove 23, the second enclosing stoppe wall 2111 is a surrounding wall of the second retention groove 23.

The provision of the retention grooves 13 and 23 facilitates accurate positioning of the gripping layers 12 and 22 during the secondary overmolding process. The enclosing stopper walls 1111 and 2111 act as physical barriers that prevent the soft gripping layers from sliding or shifting along the longitudinal direction of the handles after molding.

The first retention groove 13 is extended along a circumferential direction and is preferred to occupy a quarter to three quarters of a circumference of the first handle portion 111. The second retention groove 23 is extended along a circumferential direction and is preferred to occupy a quarter to three quarters of a circumference of the second handle portion 211. This configuration significantly increases the effective contact surface area between the hard and soft materials. The elastomer of the gripping layer fills the recessed regions and forms a mechanical key that prevents delamination or peeling even under repeated gripping and torsional loads. The circumferential distribution of the handle circumference is optimized to balance bonding area with material flexibility, ensuring that the soft layer remains firmly anchored without compromising handle deformability or comfort.

Since different portions of the gripping layers 12, 22 may be subjected to uneven stress distribution during repetitive compression and release cycles, local deformation or peeling could occur if the soft layers are not adequately confined. The enclosing stopper walls 1111 and 2111 effectively constrain the boundaries of the soft layers, thereby preventing delamination, slippage, or deformation even under long-term use.

Accordingly, the cooperation between the retention grooves and the enclosing stopper walls ensures stable integration of the soft and hard materials, improves molding precision, and enhances the mechanical interlocking effect between the handle bodies and the gripping layers. This design not only improves structural durability but also maintains a smooth, seamless appearance of the handles, thereby improving both functional reliability and aesthetic quality of the hand grip strengthener.

In this embodiment, as shown in FIG. 4, the first handle body 11 has a first indented groove 14 formed at the first bonding wall 1112 at an upper portion of the first handle portion 111 at a position adjacent to the curved spring mounting portion 112. In other words, the first indented groove 14 is formed adjacent to a connecting area between the first handle portion 111 and the curved spring mounting portion 112, so that the first indented groove 14 is formed at a middle area of the first handle body 11. The first indented groove 14 is formed after the injection molding process of the first handle body 11 at a position corresponding to an injection inlet position.

By positioning the injection inlet closer to the middle region of the first handle body 11, particularly near the curved spring mounting portion 112, the molten polymer of the first handle body 11 can maintain optimal flowability and temperature when reaching this high-stress area. This ensures that the curved spring mounting portion 112 is completely and uniformly filled, preventing the occurrence of voids or incomplete solidification. In other words, the shorter flow distance minimizes premature cooling and increases the material density and mechanical strength at the critical stress-bearing section.

Accordingly, by properly arranging the injection inlet in relation to the curved spring mounting portion 112, the molding process achieves superior structural integrity, enhanced bonding performance between the soft and hard layers, and greater reliability of the curved spring mounting portion 112, effectively preventing post-molding cracking.

During injection molding, a slight recessed area is preferred to be formed on the molded surface. In this embodiment, the first indented groove 14 is deliberately formed at this position in a manner of a recessed geometry, such that when the soft first gripping layer 12 (e.g., TPE or TPR) is subsequently overmolded, the injected soft material can flow into and fill the first indented groove 14. As a result, a mechanical interlocking interface is formed between the hard first handle body 11 and the soft first gripping layer 12.

The recessed first indented groove structure enhances the bonding strength between the hard and soft materials, thereby improving adhesion and preventing delamination of the overmolded layer during repeated compression. The soft material filled in the indented first groove 14 also smooths out the surface depression caused by the injection inlet, thereby improving the overall surface appearance and aesthetic continuity of the handle.

Accordingly, by strategically forming the first indented groove 14 at the injection inlet position, the present design simultaneously achieves enhanced bonding performance and improved visual quality, while utilizing a simple and efficient molding structure without additional processing steps.

Alternatively, the first indented groove 14 in other embodiments may be formed at a lower portion of the first handle portion 11 at a rear side thereof, and the first gripping layer 12 covers the first indented groove 14.

In particular, the first gripping layer 12 is overmolded onto the outer surface of the first handle portion 11 at a position corresponding to the first retention groove 13 such that it completely covers the first indented groove 14. During the second injection molding stage, the molten elastomeric material flows into and fills the first indented groove 14, forming a continuous encapsulating layer after solidification. As a result, the first indented groove 14 is an injection gate mark concealed beneath the surface of the first gripping layer 12, thereby providing an aesthetically smooth and integrated outer contour for the handle. The encapsulation not only improves the visual appearance by eliminating visible gate marks or depressions left by the first molding step, but also enhances the overall tactile quality of the gripping area.

As shown in FIG. 9, the second handle body 21 has a second indented groove 24 formed at the second connecting portion 213, so that when the second connecting portion 213 is movably coupled with the first connecting portion 113 of the first handle body 11, the second indented groove 24 is actually not viewable by the user. The second indented groove 14 is formed after the injection molding process of the second handle body 21 at a position corresponding to an injection inlet position.

In this embodiment, the curved spring mounting portion 112 is formed in a tapered configuration that is thicker at a lower portion adjacent to the first handle portion 111 and gradually thinner toward its upper free end. The curved spring mounting portion 112 is integrally extended upwardly from the second handle portion 211 and serves as the main load-transmitting section for supporting and anchoring the spring element 31. The lower thick portion provides a strong structural foundation for connection with the handle body, while the upper thinner portion allows controlled flexibility and stress transition when the spring element 31 is repeatedly compressed and released during operation.

Accordingly, when the user applies a squeezing force, the spring element 31 transmits a reaction load to the curved spring mounting portion 112. If the curved spring mounting portion 112 has a uniform thickness, stress tends to concentrate at the junction between the first handle portion 111 and the curved spring mounting portion 112, leading to potential cracking. The tapered configuration creates a gradual stiffness transition, dispersing stress along the curved profile and effectively reducing local stress concentration. This improves the fatigue life and overall structural reliability of the hand grip strengthener.

The thicker lower section functions as a reinforced root, providing higher bending and shear strength where the moment arm is largest. This ensures that the high-stress region near the connection with the handle body remains rigid and resistant to deformation under repeated loading.

The thinner upper portion offers controlled flexibility, allowing slight elastic deformation that harmonizes with the deflection of the spring element 31. This structural compliance reduces the peak load transferred to the spring, thereby stabilizing the overall stress distribution and preventing brittle fracture.

The gradual tapering also reduces excess material mass at the top, optimizing weight distribution for better balance during operation. This not only reduces hand fatigue but also contributes to a more refined and ergonomic handling experience.

From a molding perspective, the tapered geometry promotes smoother resin flow during injection, minimizing air entrapment and improving filling at the high-stress region near the upper end. This corresponds with the optimized injection gate location discussed earlier, ensuring adequate material density and hardness at the curved section, further preventing bubbles or insufficient hardness that could lead to fracture.

A tapered groove 15 is formed at the bottom portion of the curved spring mounting portion 112, the tapered groove 15 is configured with a downwardly widened shape, i.e., a structure that is narrow at the top and wide at the bottom.

During the injection molding process of the handle body, the thick section at the bottom of the curved spring mounting portion 112 tends to accumulate molten resin and form excessive filling at the transitional region between the curved spring mounting portion 112 and the first handle portion 111. This phenomenon often results in surface irregularities, local shrink marks, and unsightly bulging after solidification. By forming the tapering groove 15 at this region, the resin flow path is optimized and the material distribution becomes more uniform, thereby improving the overall flowability and surface smoothness of the molded part. The tapered groove 15 effectively prevents overaccumulation of the molten resin and eliminates appearance defects at the bent junction between the curved spring mounting portion 112 and the first handle portion 111.

Accordingly, the tapered groove 15 provides a controlled resin flow path that promotes balanced material distribution and faster venting of trapped air during the molding cycle. This prevents excessive accumulation of molten resin near the bending area and achieves a smoother outer surface without visible deformation or flow marks. As a result, the molded handle exhibits a high-quality aesthetic finish with precise contour definition.

The tapered groove 15 not only improves resin flow but also functions as a stress dispersion feature. The region between the curved spring mounting portion 112 and the first handle portion 111 typically endures repeated cyclic stress during hand gripping. Without the groove, stress tends to concentrate at the junction, increasing the likelihood of cracking or fatigue failure after prolonged use. The inclusion of the tapered groove 15 redistributes mechanical stress across a broader section, effectively reducing stress concentration and enhancing the long-term structural durability of the first handle body 11.

The curved spring mounting portion 112 comprises a body portion 1121 and a reinforcing rib 1122 that is integrally extended from an inner side of the body portion 1121. The reinforcing rib 1122 is formed in a protruding configuration and is preferably designed with a width that gradually increases toward the first handle portion 111, such that the rib transitions smoothly into the main handle structure. In one preferred embodiment, the width of the reinforcing rib 1122 ranges from 5% to 90% of the top width of the body portion 1121, depending on the required rigidity and load distribution of the curved spring mounting portion 112.

The reinforcing rib 1122 increases the local moment of inertia of the curved spring mounting portion 112, improving its resistance to bending and torsional stress when the spring element 31 is compressed and released. This prevents fracture or fatigue failure in the high-stress curved region.

During injection molding, the curved spring mounting portion 112 experiences both thermal expansion and pressure from molten resin flow, particularly at its thinner upper section. The reinforcing rib 1122 acts as an internal brace, maintaining the shape of the curved section, preventing collapse or cracking, and ensuring consistent dimensional accuracy. This reduces defects and improves production yield.

The gradually widening geometry of the rib provides a smooth transition of stiffness between the curved portion and the main handle body, which reduces localized stress concentration both during molding and during repeated use, improving fatigue resistance.

In addition, in this embodiment, the curved spring mounting portion 112, which is a high-stress region of the second handle body 21, is provided with a mounting groove 16 specifically configured for receiving and anchoring the fixing end portion 312 of the spring element 31. The mounting groove 16 is dimensioned such that it securely retains the spring end while allowing sufficient clearance for the rotational movement of the spring element 31 during compression and release cycles. The groove depth is designed to maintain the mechanical integrity and bending strength of the curved spring mounting portion 112, preventing weakening or fracture at this critical high-stress location.

The adjustment control element 33 comprises an adjusting knob 331 and a driving shaft 332 connected to the adjusting knob 331. The spring driving element 32 is movably coupled on the driving shaft 332 in a manner that when the adjusting knob 331 is rotated, the spring driving element 32 will be driven to move by the driving shaft 332, so as to further drive the moving end portion 311 of the spring element 31 to move, so that the spring body 313 is deformed into different tension states to generate different resistances to the relative movement between the first operation handle 10 and the second operation handle 20.

In this embodiment, the spring element 31 can be a compression spring. The movement of the moving end portion 311 of the spring element 31 will result in different stretching states of the compression spring, so as to adjust the resistance of the spring element 31 applied to the relative movement between the first operation handle 10 and the second operation handle 20.

Referring to FIGS. 15 to 18 of the drawings, a hand grip strengthener according to an alternative mode of the above embodiment comprises a first operation handle 10, a second operation handle 20, a strength adjustment assembly 30 for adjusting the resistance for the user. The first operation handle 10 is coupled with the second operation handle 20 for a hand of a user to grip thereon and the two operation handles are capable of being moved away from or close to each other.

The first operation handle 10 comprises a first handle body 11 which comprises a first handle portion 111, a curved spring mounting portion 112 extended from the first handle portion 111, and a first connecting portion 113 which is movably coupled to the second operation handle 20. The second operation handle 20 comprises a second handle body 21 which comprises a second handle portion 211, a base portion 212 connected to the second handle portion 211 for assembling the strength adjustment assembly 30, and a second connecting portion 213 extended from the base portion 212 for movably coupling with the first connecting portion 113. In this embodiment, the above mentioned gripping layers 12 and 22 are omitted.

Figure 17:
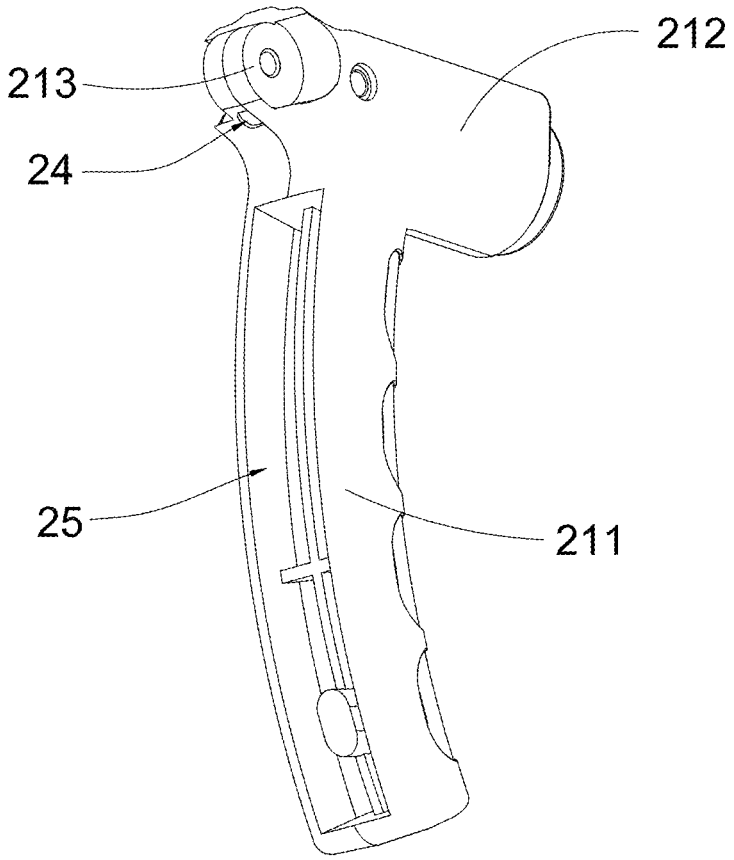
FIG. 17 is a perspective view of a second operation handle of the hand grip strengthener according to the alternative mode of the above embodiment of the present invention.
Figure 18:
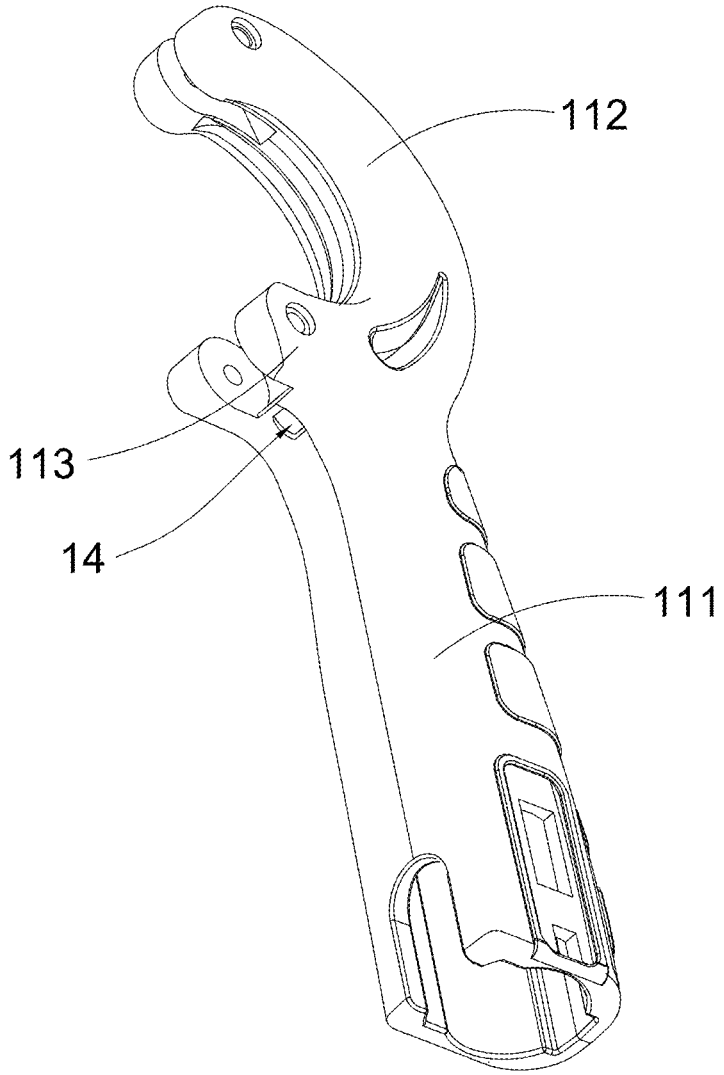
FIG. 18 is a perspective view of a first operation handle of the hand grip strengthener according to the alternative mode of the above embodiment of the present invention.

As shown in FIG. 18 of the drawings, a first indented groove 14 is formed at the first connecting portion 113 at a front side of the first handle body 11. As shown in FIG. 17 of the drawings, the second indented groove 24 is formed at the second connecting portion 213 at a rear side of the second handle body 21, so that the first indented groove 14 and the second indented groove 24 are not easy to be viewed by the user. By positioning the grooves at the connecting regions between the two handle bodies, the first indented groove 14 and the second indented groove 24 are injection gate marks naturally concealed from the user's line of sight during gripping. This configuration not only maintains a clean and aesthetically pleasing external appearance of the hand grip strengthener but also prevents visual exposure of the injection gate marks formed during molding.

The second handle body 21 further has a recessed groove 25 formed at a rear side of the second handle portion 211, so as to the second handle portion 211 adopts a hollow structural design, wherein the recessed groove 25 is defined to partially reduce the wall thickness at the inner side of the second handle portion 211. Such configuration effectively reduces the overall material usage and weight of the hand grip strengthener while maintaining sufficient structural rigidity and mechanical strength required for repeated compression operations.

Accordingly, the second handle body 21 achieves an optimal balance between lightweight design, material economy, and mechanical performance, thereby improving both the ergonomic comfort and manufacturing efficiency of the product.

Referring to FIGS. 10 to 14 of the drawings, a molding system 40 and an injection molding manufacturing method for manufacturing the hand grip strengthener is illustrated. The molding system 40 comprises a first molding equipment 41 for molding the first handle body 11 and the second handle body 21, a second molding equipment 42 for molding the gripping layers 12 and 22 on the first handle body 11 and the second handle body 21 respectively.

Figure 10:
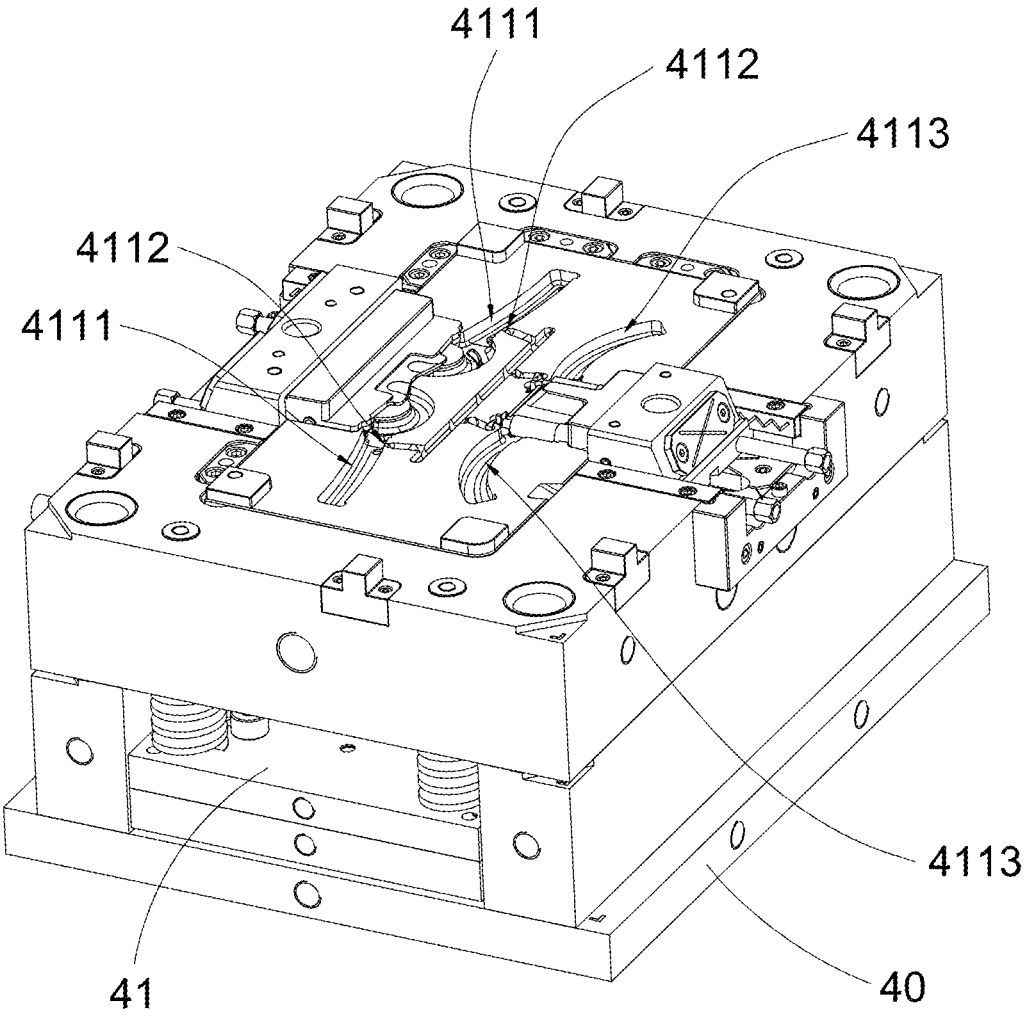
FIG. 10 is a perspective view of a first injection molding equipment of a molding system for manufacturing the hand grip strengthener according to the above embodiment of the present invention.
Figure 11:
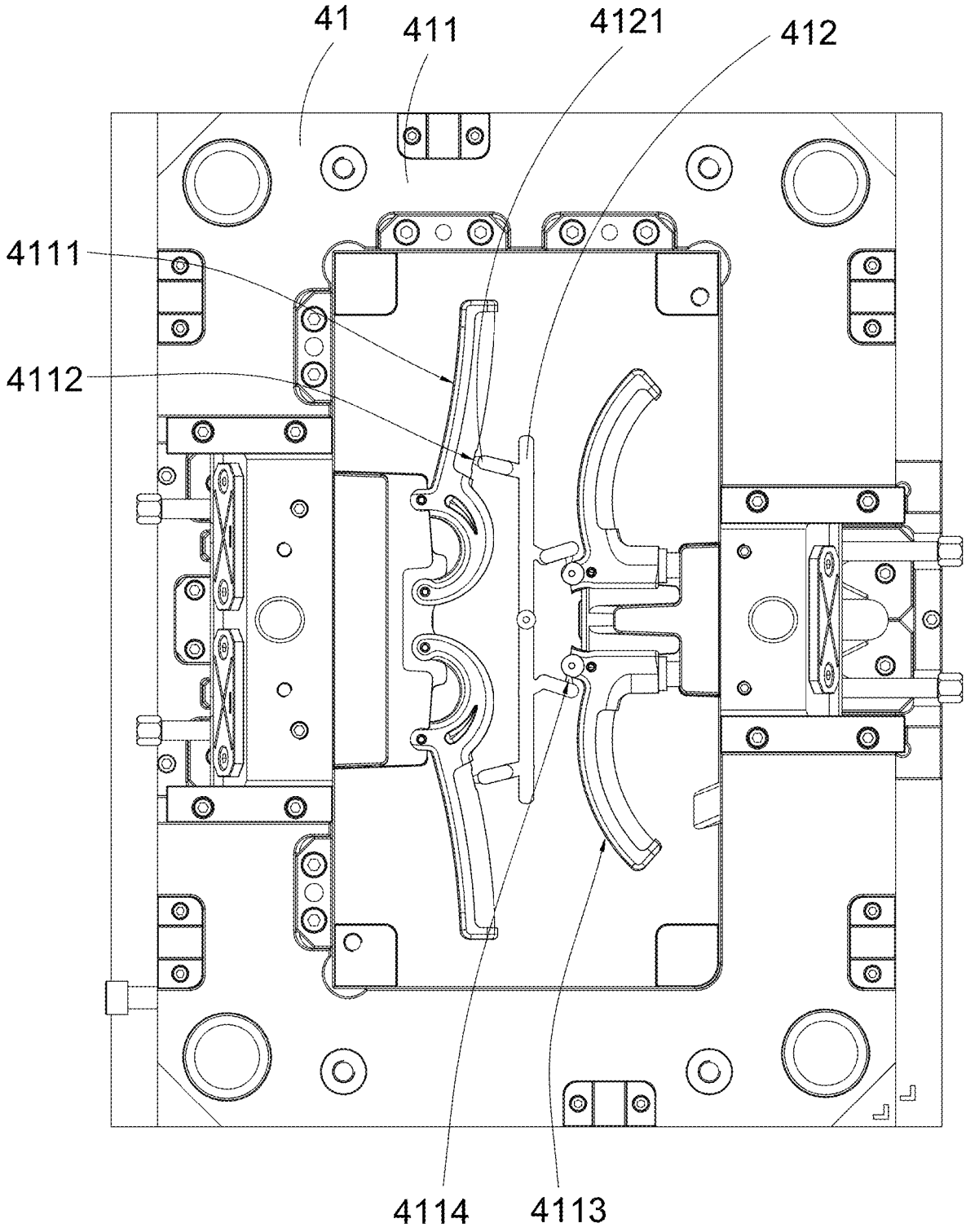
FIG. 11 is a schematic view of the first injection molding equipment of the molding system for manufacturing the hand grip strengthener according to the above embodiment of the present invention.
Figure 12:
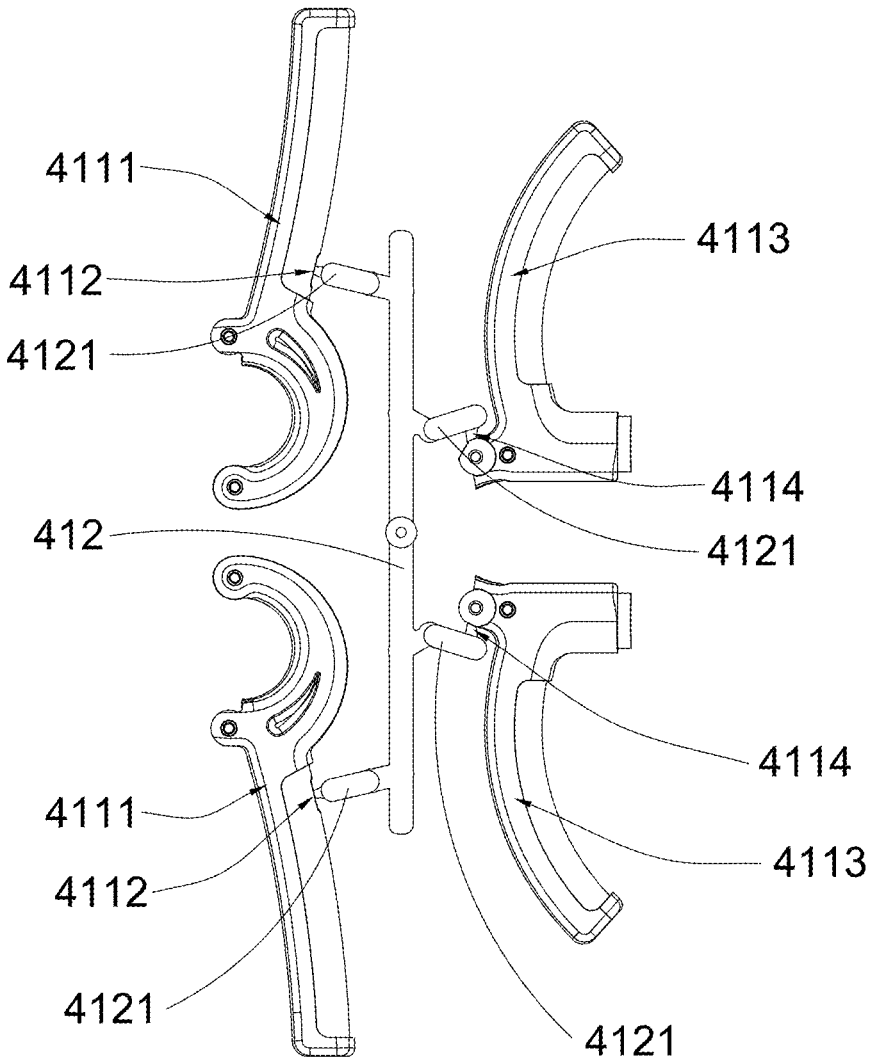
FIG. 12 is a schematic view illustrating handle forming channels and a fluid feeding pipeline of the first injection molding equipment of the molding system for manufacturing the hand grip strengthener according to the above embodiment of the present invention.

As shown in FIGS. 10 to 12, the first molding equipment 41 comprises a molding cavity body 411 having one or more first handle forming channels 4111 each having a first injection gate 4112, and one or more second handle forming channels 4113 each having a second injection gate 4114. The first molding equipment 41 further comprises a fluid feeding pipeline 412 for feeding the molding material into the first handle forming channels 4111 and the second handle forming channels 4113 through the first injection gates 4112 and the second injection gates 4114.

The fluid feeding pipeline 412 comprises a plurality of feeding heads 4121 which can be detachably inserted into the corresponding injection gates 4112 and 4114 for feeding the molding material into the first handle forming channels 4111 and the second handle forming channels 4113. After each feeding head 4121 is withdrawn from the corresponding injection gate, and the molding material is solidified in the corresponding handle forming channel, the position of the first handle portion 111 and the second handle portion 211 corresponding to the injection gates 4112 and 4114 will form the corresponding first indented groove 14 and the second indented groove 24.

As shown in FIG. 12 of the drawings, the molding cavity body 411 has two first handle forming channels 4111 which are symmetrical to each other, and two second handle forming channels 4113 which are also symmetrical to each other, the fluid feeding pipeline 412 is positioned between the group of the first handle forming channels 4111 and the group of the second handle forming channels 4113.

During the molding process, as an example, the material for molding the first handle body 11 and the second handle body 21 is polypropylene, the temperature of the fluid molten material is 210° C.-230° C., the temperature of the molding cavity body 411 is 50° C.-80° C., the flow speed is 5-80 mm/s, the pressure in the handle forming channels is 40-100 Mpa.

In the injection molding process of the polypropylene (PP) material, the flow rate of the molten resin can be divided into multiple such as four sequential stages. The first two stages are primarily responsible for filling the mold cavity, while the latter two stages serve to stabilize the flow and eliminate molding defects. Specifically, in the first stage, the injection speed can be set to 65 mm/s, which allows the molten PP to rapidly fill approximately 70%-80% of the mold volume. This prevents the formation of cold weld lines and ensures a uniform temperature distribution.

In the second stage, the injection speed is reduced to 55 mm/s to slow down the flow impact, thereby preventing defects such as melt jetting, burning, or flow marks.

In the third stage, the flow rate is further decreased to 25 mm/s for slow filling of the remaining cavity end portion. This helps control the flow front, reduce gas entrapment, and improve the compactness and density of the molded part.

Finally, in the fourth stage, the speed is lowered to 10 mm/s to achieve a smooth transition to the holding pressure phase. This low-speed compensation ensures that the molten resin completely fills the cavity without backflow or flash formation, while minimizing internal stress and deformation in the finished product.

Figure 13:
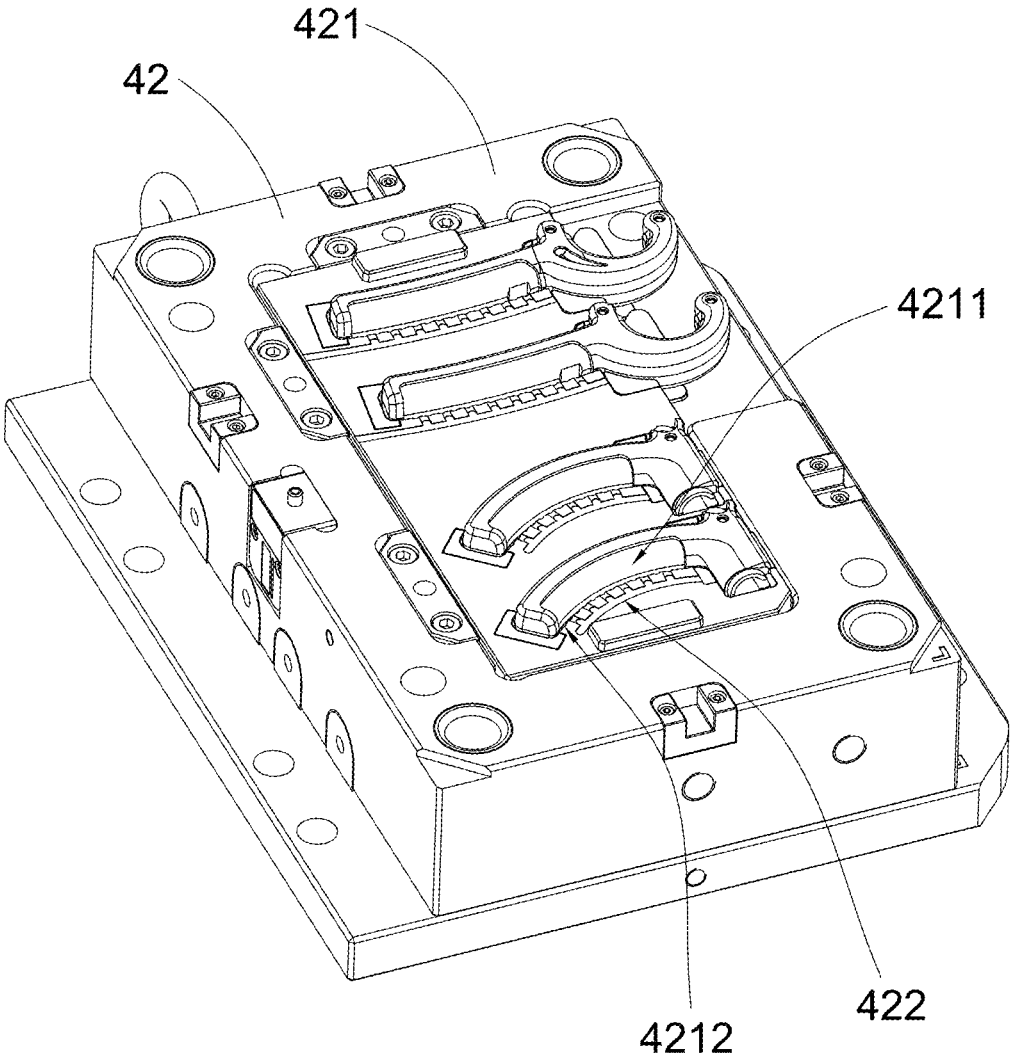
FIG. 13 is a perspective view of a second injection molding equipment of the molding system for manufacturing the hand grip strengthener according to the above embodiment of the present invention.
Figure 14:
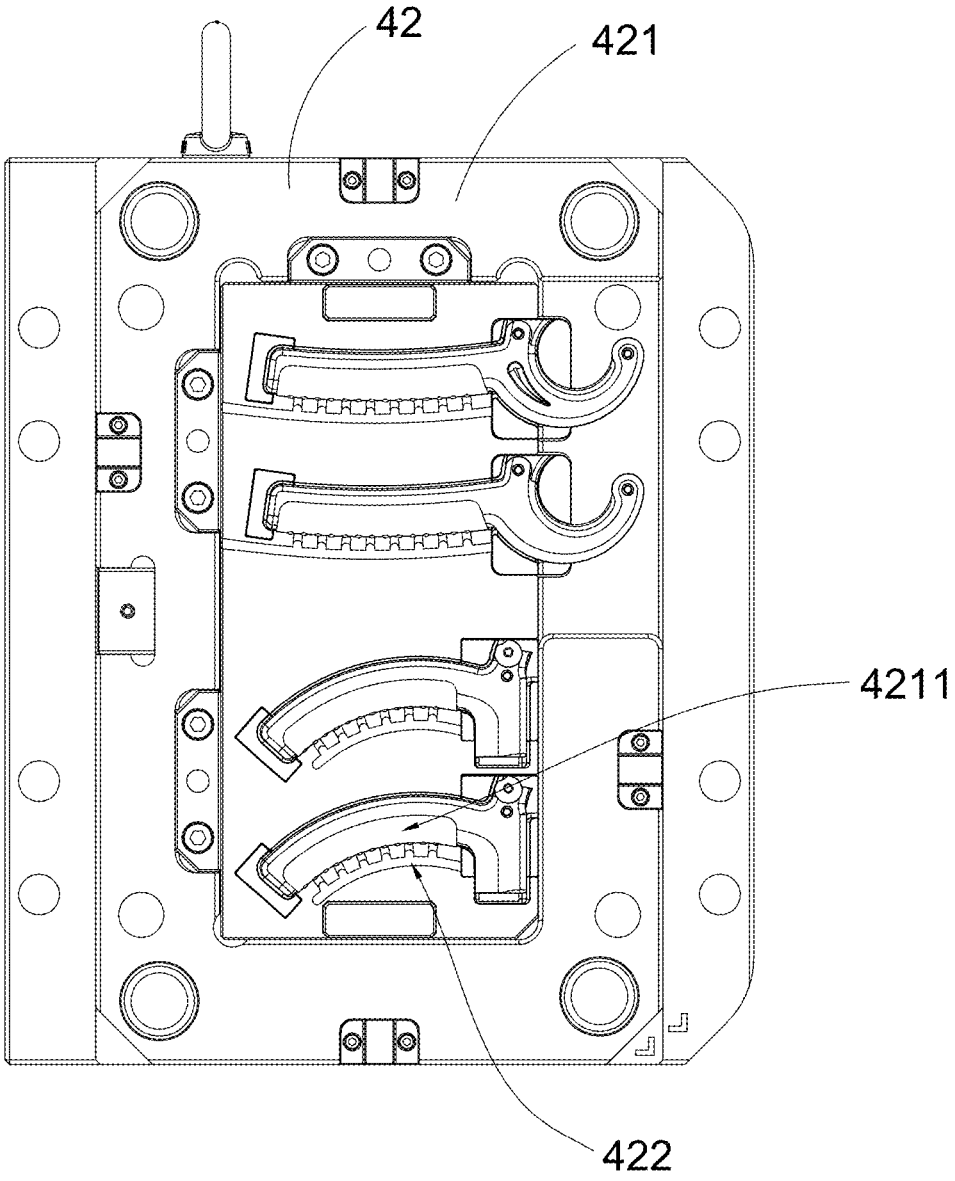
FIG. 14 is a schematic view of the second injection molding equipment of the molding system for manufacturing the hand grip strengthener according to the above embodiment of the present invention.
Figure 15:
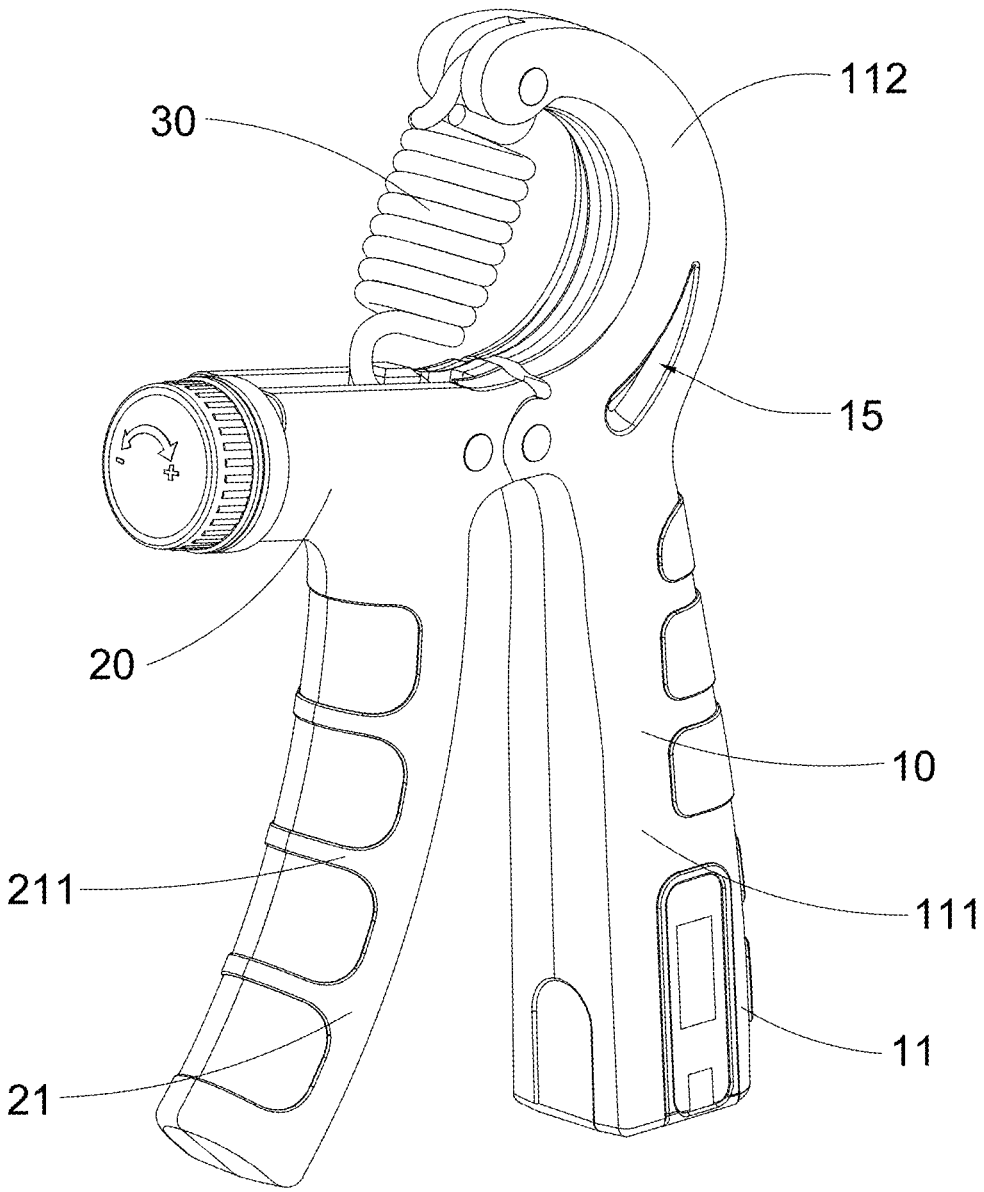
FIG. 15 is a perspective view of a hand grip strengthener according to an alternative mode of the above embodiment of the present invention.
Figure 16:
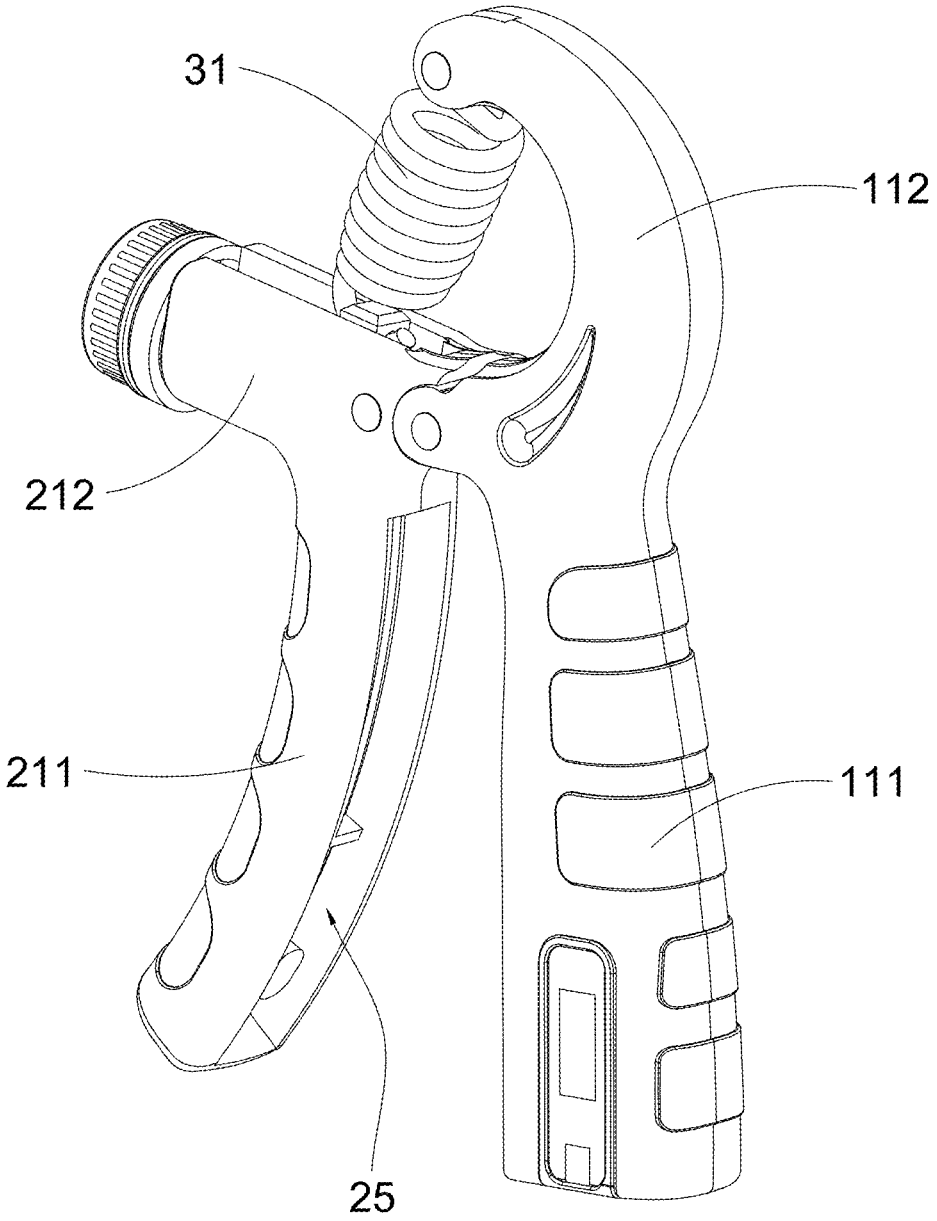
FIG. 16 is another perspective view of the hand grip strengthener according to the alternative mode of the above embodiment of the present invention.

Referring to FIGS. 13 to 14, the second molding equipment 42 comprises an overmolding cavity body 421 having a plurality of overmolding channels 4211 each having an injection gate 4212, and a plurality of overmolding feeding pipelines 422 for feeding the overmolding material of the gripping layers 12 and 22 into the corresponding overmolding channels 4211 through the corresponding injecting gages 4212.

During the second injection process, the previously molded first handle body 11 and second handle body 21 are positioned within the overmolding cavity body 421, and the molten material, such as TPE or TPR material, is injected around the handle surfaces to form the first gripping layer 12 and the second gripping layer 22. The TPE or TPR material, having excellent elasticity and adhesion compatibility with polypropylene, flows into the first indented groove 14 and second indented groove 24, forming a strong mechanical interlock and ensuring a firm bond between the soft and hard layers.

During the overmolding process, the temperature of the TPE or TPR fluid molten material is 210° C.-230° C., the flow speed is 5-50 mm/s, the temperature of the overmolding channels 4211 is 30° C.-50° C.

The temperature of the TPE or TPR fluid molten material is substantial the same as the the temperature of the fluid molten material for molding the first handle body 11 and the second handle body 21. Because TPE (or TPR) contains PP components within its molecular structure, the two materials can be integrally fused and overmolded during the molding process without requiring additional surface treatment or adhesives. This ensures a strong, stable, and durable bond between the soft and hard layers.

After solidification, the soft TPE or TPR layers conform tightly to the handle surfaces, achieving a smooth and continuous appearance. Since the injection gate marks left on the TPE or TPR surface after overmolding are visually subtle and minimally detectable, the overall surface quality and aesthetic appearance of the finished hand grip strengthener are significantly improved.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A hand grip strengthener, comprising:

a first operation handle which comprises a first handle body;

a second operation handle which is movably coupled to the first operation handle and comprises a second handle body, wherein the first handle body and the second handle body are injection molded; and a strength adjustment assembly arranged to generate a resistance force to a relative movement between the first operation handle and the second operation handle;

wherein the first operation handle further comprises a first gripping layer which is overmolded on the first handle body, the second operation handle further comprises a second gripping layer which is overmolded on the second handle body;

wherein the strength adjustment assembly comprises a spring element, wherein the first handle body comprises a first handle portion, a curved spring mounting portion extended from the first handle portion, and a first connecting portion, wherein the second handle body comprises a second handle portion, a base portion extended from the second handle portion and a second connecting portion which is movably connected to the first connecting portion, wherein the spring element is connected to the curved spring mounting portion and is inclinedly arranged between the curved spring mounting portion and the base portion of the second handle body, wherein the first gripping layer is overmolded on a rear side of the first handle portion, the second gripping layer is overmolded on a front side of the second handle portion;

wherein the first handle body has a first indented groove formed at a rear side of the first handle portion, wherein the first gripping layer is integrally molded on the first handle body to conceal the first indented groove.

2. The hand grip strengthener according to claim 1, wherein the first indented groove is an injection gate mark formed after an injection molding process of the first handle body.

3. The hand grip strengthener according to claim 1, wherein the second handle body has a second indented groove formed at a rear side of the second connecting portion, wherein the second indented groove is an injection gate mark formed after an injection molding process of the second handle body.

4. A hand grip strengthener, comprising:

a first operation handle which comprises a first handle body;

a second operation handle which is movably coupled to the first operation handle and comprises a second handle body, wherein the first handle body and the second handle body are injection molded; and a strength adjustment assembly arranged to generate a resistance force to a relative movement between the first operation handle and the second operation handle;

wherein the first operation handle further comprises a first gripping layer which is overmolded on the first handle body, the second operation handle further comprises a second gripping layer which is overmolded on the second handle body;

wherein the strength adjustment assembly comprises a spring element, wherein the first handle body comprises a first handle portion, a curved spring mounting portion extended from the first handle portion, and a first connecting portion, wherein the second handle body comprises a second handle portion, a base portion extended from the second handle portion and a second connecting portion which is movably connected to the first connecting portion, wherein the spring element is connected to the curved spring mounting portion and is inclinedly arranged between the curved spring mounting portion and the base portion of the second handle body, wherein the first gripping layer is overmolded on a rear side of the first handle portion, the second gripping layer is overmolded on a front side of the second handle portion;

wherein the first handle portion comprises a first bonding wall and a first enclosing stopper wall extended from the first bonding wall to define a first retention groove, wherein the first gripping layer is overmolded and fitted to the first bonding wall at the first retention groove.

5. The hand grip strengthener according to claim 4, wherein the first handle body has a first indented groove formed at the first bonding wall at an upper portion of the first handle portion adjacent to the curved spring mounting portion, wherein the first gripping layer is integrally molded on the first handle portion to conceal the first indented groove.

6. The hand grip strengthener according to claim 4, wherein the first retention groove is extended along a circumferential direction to occupy a quarter to three quarters of a circumference of the first handle portion.

7. The hand grip strengthener according to claim 6, wherein the second handle portion comprises a second bonding wall and a second enclosing stopper extended from the second bonding wall to define a second retention groove, wherein the second gripping layer is overmolded and fitted to the second bonding wall at the second retention groove, wherein the second retention groove is extended along a circumferential direction to occupy a quarter to three quarters of a circumference of the second handle portion.

8. A hand grip strengthener, comprising:

a first operation handle which comprises a first handle body;

a second operation handle which is movably coupled to the first operation handle and comprises a second handle body, wherein the first handle body and the second handle body are injection molded; and a strength adjustment assembly arranged to generate a resistance force to a relative movement between the first operation handle and the second operation handle;

wherein the first operation handle further comprises a first gripping layer which is overmolded on the first handle body, the second operation handle further comprises a second gripping layer which is overmolded on the second handle body;

wherein the strength adjustment assembly comprises a spring element, wherein the first handle body comprises a first handle portion, a curved spring mounting portion extended from the first handle portion, and a first connecting portion, wherein the second handle body comprises a second handle portion, a base portion extended from the second handle portion and a second connecting portion which is movably connected to the first connecting portion, wherein the spring element is connected to the curved spring mounting portion and is inclinedly arranged between the curved spring mounting portion and the base portion of the second handle body, wherein the first gripping layer is overmolded on a rear side of the first handle portion, the second gripping layer is overmolded on a front side of the second handle portion;

wherein a tapered groove is formed at a lower portion of the curved spring mounting portion, wherein the tapered groove is configured with a downwardly widened shape.

9. A hand grip strengthener, comprising:

a first operation handle which comprises a first handle body injection molded by polypropylene, wherein the first handle body comprises a first handle portion, a curved spring mounting portion extended from the first handle portion, and a first connecting portion, wherein the first operation handle further comprises a first gripping layer which is a thermoplastic elastomer layer or thermoplastic rubber layer overmolded on the first handle portion of the first handle body, wherein the first handle body has a first indented groove formed at an upper portion of the first handle portion adjacent to the curved spring mounting portion, wherein the first gripping layer is integrally molded on the first handle portion to conceal the first indented groove which is an injection gate mark after an injection molding process of the first handle body;

a second operation handle which comprises a second handle body injection molded by polypropylene, wherein the second handle body comprises a second handle portion, a base portion extended from the second handle portion and a second connecting portion which is movably connected to the first connecting portion; and a strength adjustment assembly which comprises a spring element, a spring driving element, and an adjustment control element, wherein the spring element is arranged to generate a resistance force to a relative movement between the first operation handle and the second operation handle, the adjustment control element is arranged to drive the spring driving element to move, so as to drive the spring element to move and deform, so as to adjust the resistance force, wherein the spring element is connected to the curved spring mounting portion and is inclinedly arranged between the curved spring mounting portion and the base portion of the second handle body.

* * * * *